US005616835A

United States Patent [19]

Schnaibel et al.

[11] Patent Number: 5,616,835

[45] Date of Patent: Apr. 1, 1997

[54] SYSTEM FOR OPERATING A HEATING ELEMENT FOR A CERAMIC SENSOR IN A MOTOR VEHICLE

[75] Inventors: Eberhard Schnaibel, Hemmingen; Erich Schneider, Kirchheim; Konrad Henkelmann, Friolzheim; Frank Blischke; Georg Mallebrein, both of Stuttgart, all of Germany

[73] Assignee: Robert Bosch GmbH, Stuttgart, Germany

[21] Appl. No.: 295,903

[22] PCT Filed: Dec. 2, 1993

[86] PCT No.: PCT/DE93/01149

§ 371 Date: Sep. 8, 1994

§ 102(e) Date: Sep. 8, 1994

[87] PCT Pub. No.: WO94/16371

PCT Pub. Date: Jul. 21, 1994

[30] Foreign Application Priority Data

Jan. 12, 1993 [DE] Germany ..... 43 00 530.6

[51] Int. Cl.[6] ..... F02D 41/14

[52] U.S. Cl. ..... 73/117.2; 123/697

[58] Field of Search ..... 123/697; 73/112, 73/116, 117.2, 117.3, 118.1, 118.2

[56] References Cited

U.S. PATENT DOCUMENTS

| | | | |
|---|---|---|---|
| 4,303,613 | 12/1981 | Yasuda et al. . | |
| 4,348,583 | 9/1982 | Bube et al. . | |
| 4,561,402 | 12/1985 | Nakano et al. | 123/697 |
| 4,611,562 | 9/1986 | Nakano et al. | 123/697 |
| 4,655,182 | 4/1987 | Nakano et al. | 123/440 |
| 4,715,343 | 12/1987 | Kinoshita . | |
| 4,721,088 | 1/1988 | Mieno et al. | 123/697 |
| 4,753,204 | 6/1988 | Kojima et al. | 123/697 |
| 4,889,098 | 12/1989 | Suzuki et al. | 123/697 |
| 4,938,196 | 7/1990 | Hoshi et al. . | |
| 4,993,392 | 2/1991 | Tanaka et al. | 123/697 |
| 5,054,452 | 10/1991 | Denz . | |
| 5,148,795 | 9/1992 | Nagai et al. . | |
| 5,167,120 | 12/1992 | Junginger et al. | 60/274 |
| 5,218,946 | 6/1993 | Wild et al. | 123/697 |

FOREIGN PATENT DOCUMENTS

| | | |
|---|---|---|
| 0068178 | 1/1983 | European Pat. Off. . |
| 2394223 | 1/1979 | France . |
| 3933517 | 4/1990 | Germany . |
| 90/06431 | 6/1990 | Germany . |
| 91/09219 | 6/1991 | Germany . |

*Primary Examiner*—Richard Chilcot
*Assistant Examiner*—Eric S. McCall
*Attorney, Agent, or Firm*—Kenyon & Kenyon

[57] ABSTRACT

A system for operating a heating element (114) of a ceramic sensor (112) which is arranged in the exhaust channel (104) of an internal combustion engine (100) and which can be heated by the heating element (114). If the internal combustion engine (100) is in an operating state in which it can be assumed that liquid is present in the exhaust channel (114) of the internal combustion engine (100), the heating element (114) is not activated or is triggered such that the ceramic sensor (112) is operated below a critical temperature (TSeK). Above the critical temperature (TSeK) there is a risk that the ceramic sensor (112) will be damaged due to contact with liquid.

21 Claims, 4 Drawing Sheets

P
Ia
Ib
II
P1
P2
0
to
t
TSe
TSe k
TSe 1
0
to
t
TAbg
T Tau
0
to
t

SYSTEM FOR OPERATING A HEATING ELEMENT FOR A CERAMIC SENSOR IN A MOTOR VEHICLE

FIELD OF THE INVENTION

The present invention relates to a system for operating a heating element for a ceramic sensor in a motor vehicle.

BACKGROUND INFORMATION

A system for operating a heating element for a ceramic sensor in a motor vehicle is described in U.S. Pat. No. 4,348,583. There, a constant current is fed to a heating element during a first time interval. During a second time interval, the current is pulsed so that reduced power is used for heating during the second time interval. Using this type of triggering of the heating element, a high heating power is made available during the first time interval in order to attain a desired temperature as rapidly as possible. During the second time interval, reduced power is used for heating in order to maintain the temperature.

An oxygen sensor serves to measure the oxygen content of the exhaust gas and to provide an apparatus for controlling the air/fuel ratio. Until now, the oxygen sensor was generally situated very far forward in the exhaust channel, i.e., near to the internal combustion engine, in order to guarantee that the oxygen sensor was heated rapidly by the exhaust gases of the internal combustion engine.

In order to heat the oxygen sensor even more rapidly, it is generally equipped with an electrical heating element. Moreover, it can be ensured by way of the heating element that the oxygen sensor is maintained at operating temperature even under operating conditions whereby the exhaust temperature is low and/or only a very small quantity of exhaust gases are present.

However, problems can arise if the oxygen sensor is situated near to the internal combustion engine:

First, if the internal combustion engine is operated at high power for a long time, a large quantity of very hot exhaust gases will be produced which can possibly heat the oxygen sensor to an intolerably high temperature. This can reduce the service life of the oxygen sensor.

Second, it is generally difficult to find a suitable installation site for the oxygen sensor in the exhaust channel near to the internal combustion engine from which the exhaust gases from all cylinders of the internal combustion engine can be measured.

These difficulties can be circumvented by situating the oxygen sensor downstream, i.e., away from the internal combustion engine, in the exhaust channel. However, this second installation site entails a new problem. In the initial phase after starting a cold internal combustion engine, the exhaust channel upstream from the oxygen sensor will remain relatively cold. This will result in the condensation of the water contained in the exhaust gases. If the condensed water droplets are, for example, pulled loose from the wall of the exhaust passage by the exhaust gases streaming by and slung onto the oxygen sensor, the oxygen sensor will be cooled down very rapidly at the local points of impingement. This cooling can result in damage to the oxygen sensor (e.g., cracks in the ceramics). The risk of damage is particularly high if the oxygen sensor is already at a high temperature.

SUMMARY OF THE INVENTION

The underlying object of the present invention is, in a system of the type described above for operating a heating element for a ceramic sensor in a motor vehicle, to set different sensor temperatures depending on the operating state of an internal combustion engine powering the motor vehicle.

A further object of the present invention is to protect the ceramic sensor from damage due to impinging liquid. At the same time, the ceramic sensor should be ready for operation as rapidly as possible and the sensor signals should suffer as little impairment as possible. Moreover, the invention allows protection of the ceramic sensor with no structural alterations whatsoever to the sensor or with only minor structural alterations, and without incurring significant additional expense.

The present invention makes it possible to influence the temperature TSe of the oxygen sensor through appropriate triggering of the heating element such that the risk of damage to the oxygen sensor due to impinging condensed water can be held very low.

An advantage of the present invention is that it allows the setting of the temperature TSe of the ceramic sensor to be adapted to the respective operating state of the internal combustion engine. An internal combustion engine is defined as having two operating states, Phase I and Phase II. During Phase I, it is assumed that liquid is present in the exhaust passage of the internal combustion engine, while in Phase II, it is not to be assumed that liquid is present in the exhaust passage of the internal combustion engine. If the internal combustion engine is in the first operating state, the heating element is not activated or the heating element is triggered such that the ceramic sensor is operated below a critical temperature TSeK. The critical temperature TSeK is selected such that, when the ceramic sensor is operated below the critical temperature TSeK, there is no appreciable risk of damage to the ceramic sensor upon contact with liquid. If the internal combustion engine is in the second operating state, the triggering of the heating element can be adjusted for an optimal operating temperature of the ceramic sensor, for example.

Distinguishing between the two named operating states in the triggering of the heating element has the advantage that the risk of damage to the ceramic sensor due to contact with liquid is eliminated so that the service life of the ceramic sensor can be extended without having to alter the design of the sensor.

A further advantage of the present invention is that three methods of operation may be used to protect the ceramic sensor. These three methods vary in cost allowing for a good compromise between cost and benefit in a wide range of applications. In the first method of operation the heating element is not activated during the first operating state of the internal combustion engine. In the second method of operation, the heating element is operated with reduced power, and in the third method of operation it is operated initially with high power and subsequently with reduced power. The transition from high power to reduced power takes place either after a pre-selected time interval has elapsed from when the internal combustion engine was started or when it can be assumed that the temperature TSe of the ceramic sensor has exceeded a threshold value TSe1. It can be determined whether the threshold value TSe1 has been exceeded from the temperature-dependent characteristics of the ceramic sensor or from the signal of a temperature sensor in thermal contact with the ceramic sensor.

Out of the three methods for protecting the ceramic sensor, the third has the added advantage that the ceramic sensor is heated very rapidly to the highest allowable temperature under the given circumstances. It is thus possible to reach the optimal operating temperature of the ceramic sensor within a short time following the transition from the first to the second operating state of the internal combustion engine. A common feature of all three methods of protecting the ceramic sensor is that they are used only when it is necessary, i.e., during the first operating state.

The first operating state is present after a cold start of the internal combustion engine. A cold start occurs when the coolant temperature of the internal combustion engine at start lies below the threshold value TKM1. The transition from the first to the second operating state of the internal combustion engine takes place after a pre-selected time interval has elapsed since the beginning of the first operating state or when it can be assumed that the temperature TAbg of the exhaust system in the vicinity of the ceramic sensor has exceeded a threshold value TTau. The threshold value TTau can be determined either from the signal of a temperature sensor which is arranged in the vicinity of the ceramic sensor or from a model which approximates the temperature TAbg of the exhaust system in the vicinity of the ceramic sensor.

In the model, the total air volume or air mass drawn in since the internal combustion engine was started is integrated and the integral is compared with a threshold value. The various methods described herein by which the transition from the first to the second operating state, can be determined opens up a wide area of application for the invention with much flexibility for taking into account the various technical considerations.

The system according to the present invention can be employed particularly advantageously with an oxygen sensor which is arranged in the exhaust channel of an internal combustion engine either upstream or downstream from a catalytic converter, seen from the direction of flow of the exhaust gases.

BRIEF DESCRIPTION OF THE DRAWINGS

The present invention is described hereafter based on the example of an oxygen probe which is located in the exhaust channel of an internal combustion engine. In principle, an application is conceivable in conjunction with any number of heatable sensors, for example, ceramic sensors, in the exhaust channel of the internal combustion engine.

Figure 1:
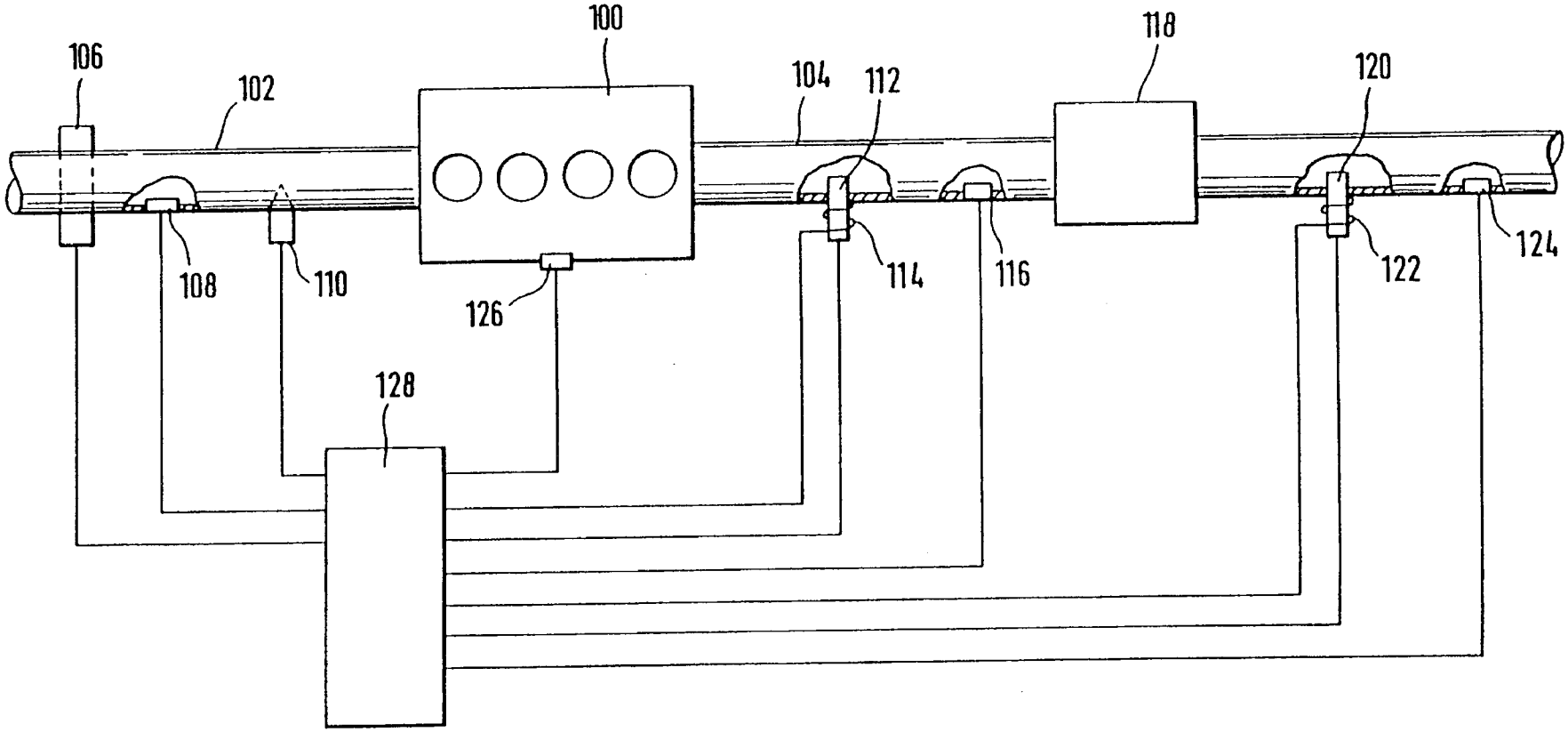
FIG. 1 shows a schematic representation of an internal combustion engine incorporating the heating element for an exhaust sensor according to the present invention.

Referring to FIG. 1, there is shown an internal combustion engine 100 having an intake system 102 and an exhaust channel 104 attached to the internal combustion engine 100. In the intake system 102 of the internal combustion engine 100, there are—seen from the direction of flow of the air drawn in—(in order) an air-mass flowmeter or air-flow-rate meter 106, a sensor 108 for measuring the temperature of the air drawn in and an injector 110. In the exhaust channel 104 of the internal combustion engine 100, there are—seen from the direction of flow of the exhaust gases—an oxygen sensor 112 having a heating element 114, a sensor 116 for measuring the temperature TAbg of the exhaust gases or the wall of the exhaust channel 104 in the vicinity of the oxygen sensor 112, a catalytic converter 118 and, optionally, a further oxygen sensor 120 having a heating element 122 and a further sensor 124 for measuring the temperature TAbg of the exhaust gases or the wall of the exhaust channel 104 in the vicinity of the oxygen sensor 120. A sensor 126 for measuring the coolant temperature of the internal combustion engine 100 is attached to the internal combustion engine 100. A control unit 128 is connected via leads to the air-mass flowmeter or air-flow-rate meter 106, the sensor 108, the injector 110, the oxygen sensor 112, the heating element 114, the sensor 116, the oxygen sensor 120, the heating element 122, the sensor 124 and the sensor 126.

Since the oxygen sensor 120 is not absolutely necessary to control the air/fuel ratio, modern system are frequently equipped only with the oxygen sensor 112 due to economic constraints. In the future, however, it appears that a two-sensor design containing both oxygen sensor 112 and oxygen sensor 120 will become more prevalent. In the description of the functional principle of the invention which follows below, an exemplified embodiment having only a single oxygen sensor 112 will be considered. The analogy with an exemplified embodiment having two oxygen sensors 112 and 120 is very simple since each heating element 114, 122 is triggered on its own according to the same principle as in the exemplified embodiment with only a single oxygen sensor 112. Separate triggering is necessary since it can generally be assumed that the oxygen sensors 112 and 120 are subject to different conditions. The differences can be particularly large following a cold start of the internal combustion engine 100. The catalytic converter 118 is then at a low temperature—generally close to the ambient temperature—and can initially store large quantities of condensed water so that the exhaust gases cool down on the way from oxygen sensor 112 to oxygen sensor 120 and accumulate liquid. The risk of damage due to contact with liquid thus exists for a considerably longer time period for oxygen sensor 120 than for oxygen sensor 112 so that the protective measures must be maintained for a correspondingly longer time for oxygen sensor 120.

The functional principle of the invention will be explained hereafter based on an exemplified embodiment having only a single oxygen sensor 112:

After the internal combustion engine 100 is started, it is first determined which operating state the internal combustion engine 100 is in. A distinction is made between two operating states:

In a first operating state, it is to be assumed that liquid, generally condensed water, is present in the exhaust channel 104 in the vicinity of the oxygen sensor 112. In a second operating state, it is to be assumed that no liquid is present in the exhaust channel 104 in the vicinity of the oxygen sensor 112. A risk of damage to the oxygen sensor 112 due to contact with liquid thus exists only in the first operating state and measures must therefore be taken to protect the oxygen sensor 112 only during the first operating state.

The first operating state is generally present after a cold start of the internal combustion engine 100 as long as the temperature TAbg of the exhaust channel in the vicinity of the oxygen sensor 112 is lower than the condensation point temperature TTau of approx. 50°–60° C. The time interval during which the internal combustion engine is in the first operating state is designated hereafter as phase I. When the condensation point temperature TTau is exceeded, a transition to the second operating state occurs and a phase II begins.

In order to determine whether a cold start is occurring, the signal from sensor 126, which measures the temperature of the coolant of the internal combustion engine 100, is evaluated immediately before or immediately after the internal combustion engine 100 is started. If the evaluation shows that the temperature of the coolant is greater than a threshold value TKM1 of, say, 75° C., then a cold start is not occurring. The internal combustion engine 100 is in the second operating state and no additional measures are necessary to protect the oxygen sensor 112 from damage due to contact with liquid, i.e., the triggering of the heating element 114 is subject to no restrictions in this context. If, in contrast, the temperature of the coolant is less than the threshold value TKM1, a cold start is occurring and it can initially be assumed that the internal combustion engine 100 is in the first operating state. Accordingly, measures must be taken to protect the oxygen sensor 112 until the second operating state is reached. These measures should prevent in each case the oxygen sensor 112 from being heated by the heating element 114 during phase I to temperatures at which a risk of damage to the oxygen sensor 112 exists due to contact with liquid. The following individual measures are available:

Measure 1

Heating element 114 remains switched off.

Measure 2

Heating element 114 is operated with a power P2 which is reduced with respect to its nominal power P1.

Measure 3

Heating element 114 is initially operated with its nominal power P1 and then, when it can be assumed that the temperature TSe of the oxygen sensor 112 has exceeded a threshold value TSe1, the heating power P is reduced such that the temperature TSe of the oxygen sensor 112 no longer increases or increases only minimally. The threshold value TSe1 lies approx. 50K below a critical temperature TSeK of, say, 300° to 350° C. above which the risk of damage to the oxygen sensor 112 upon contact with liquid is present. The temperature TSe of the oxygen sensor 112 can be estimated from the time elapsed since the heating element 114 was switched on, or it can be determined from the output signals of the oxygen sensor 112, or from the signals of a temperature sensor which is in thermal contact with the oxygen sensor 112, or using other common methods known to those skilled in the art.

The moment at which phase I ends and phase II begins can be specified either approximately using empirical values gathered during the application (Possibility 1) or as follows:

Possibility 2

Based on the signals from the temperature sensor 116, it is determined whether the condensation point temperature TTau has been exceeded in the vicinity of the oxygen sensor 112.

Possibility 3

Based on a mathematical model for the exhaust temperature which takes into account the air volume or rather air mass summed up since the internal combustion engine 100 was started, it is determined whether the condensation point temperature TTau has been exceeded in the vicinity of the oxygen sensor 112.

It is also conceivable to use a moisture sensor in the vicinity of the oxygen sensor 112 in order to determine whether the first or the second operating state of the internal combustion engine 100 is present. At the current time, this variant is relatively unimportant due to economic constraints. However, this could change as the technology evolves.

Figure 2:
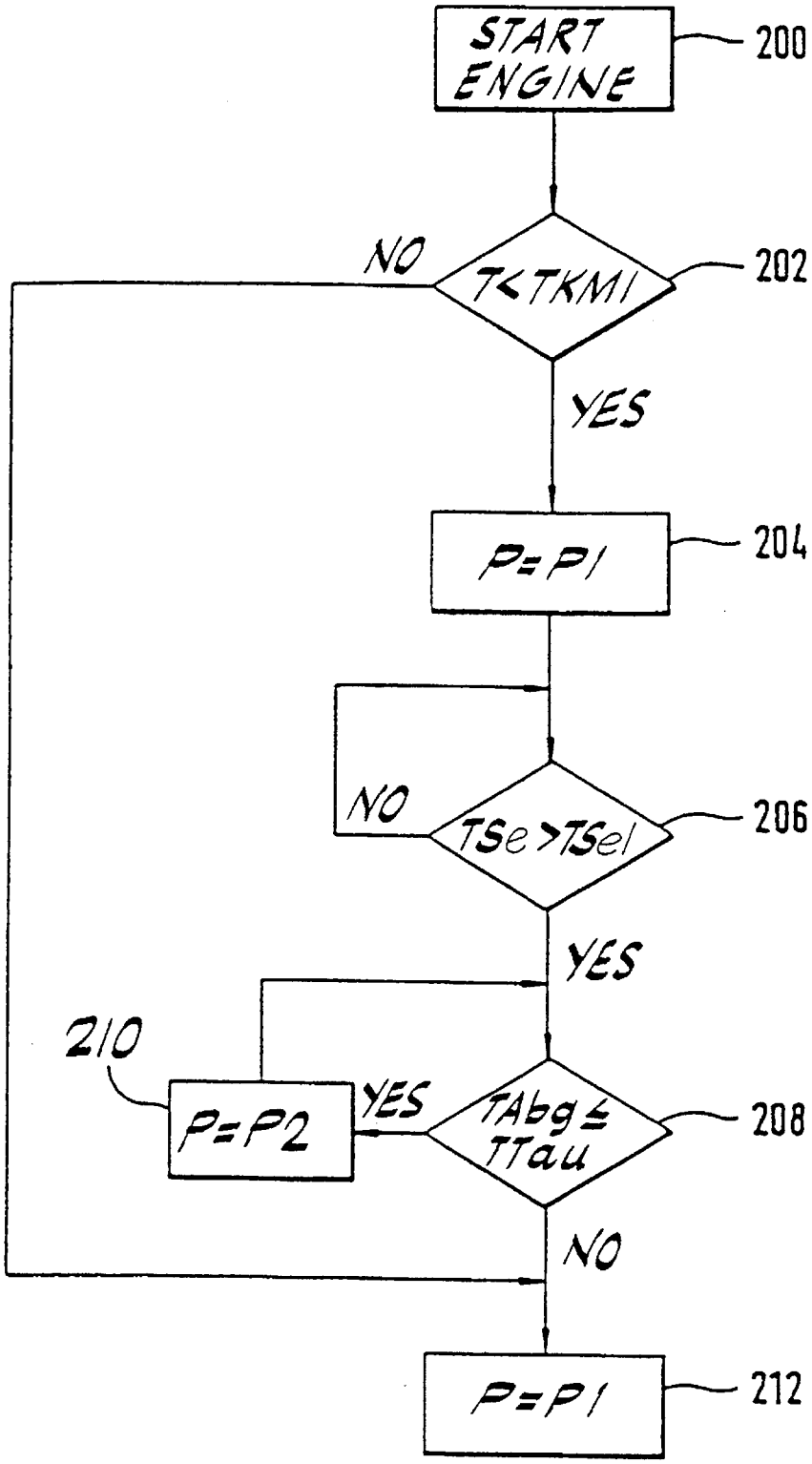
FIG. 2 shows a flow chart of the operation of a heating element for an exhaust sensor, according to the present invention.

FIG. 2 shows a flow chart of a preferred exemplified embodiment of the system according to the invention for operating the heating element 114 of a oxygen sensor 112. In this exemplified embodiment, the above-described measure 3 is used during phase I and the transition from phase I to phase II is determined according to one of the above-described possibilities 1, 2 or 3.

The flow chart starts with a first step 200 in which the internal combustion engine 100 is started. Then, in step 202, it is checked whether the coolant temperature of the internal combustion engine 100 is less than the threshold value TKM1. If this condition is met, step 204 follows. In step 204, the heating element 114 is activated with nominal power P1. Then, in step 206, it is checked whether the temperature TSe of the oxygen sensor 112 has exceeded the threshold value TSe1. This query is repeated until the checked condition is met. When the condition is met, step 208 follows. In step 208, it is checked whether it is to be assumed that liquid is present in the vicinity of the oxygen sensor 112. To answer this question, at least one of the three possibilities 1, 2 and 3 named above is used. If condition 208 is met, step 210 follows in which heating element 114 is made to operate with a power P2 which is reduced with respect to its nominal power P1. One way of reducing the power P is by pulsing the electric current flowing through heating element 114. Step 208 again follows step 210. If condition 208 is not met, step 212 follows in which heating element 114 is made to operate with its nominal power P1. Step 212 can also be reached directly from step 202; this happens when the condition for step 202 is not met, i.e., when a cold start is not occurring and thus no measures are required to protect the oxygen sensor 112 from damage due to contact with liquid.

Figure 3:
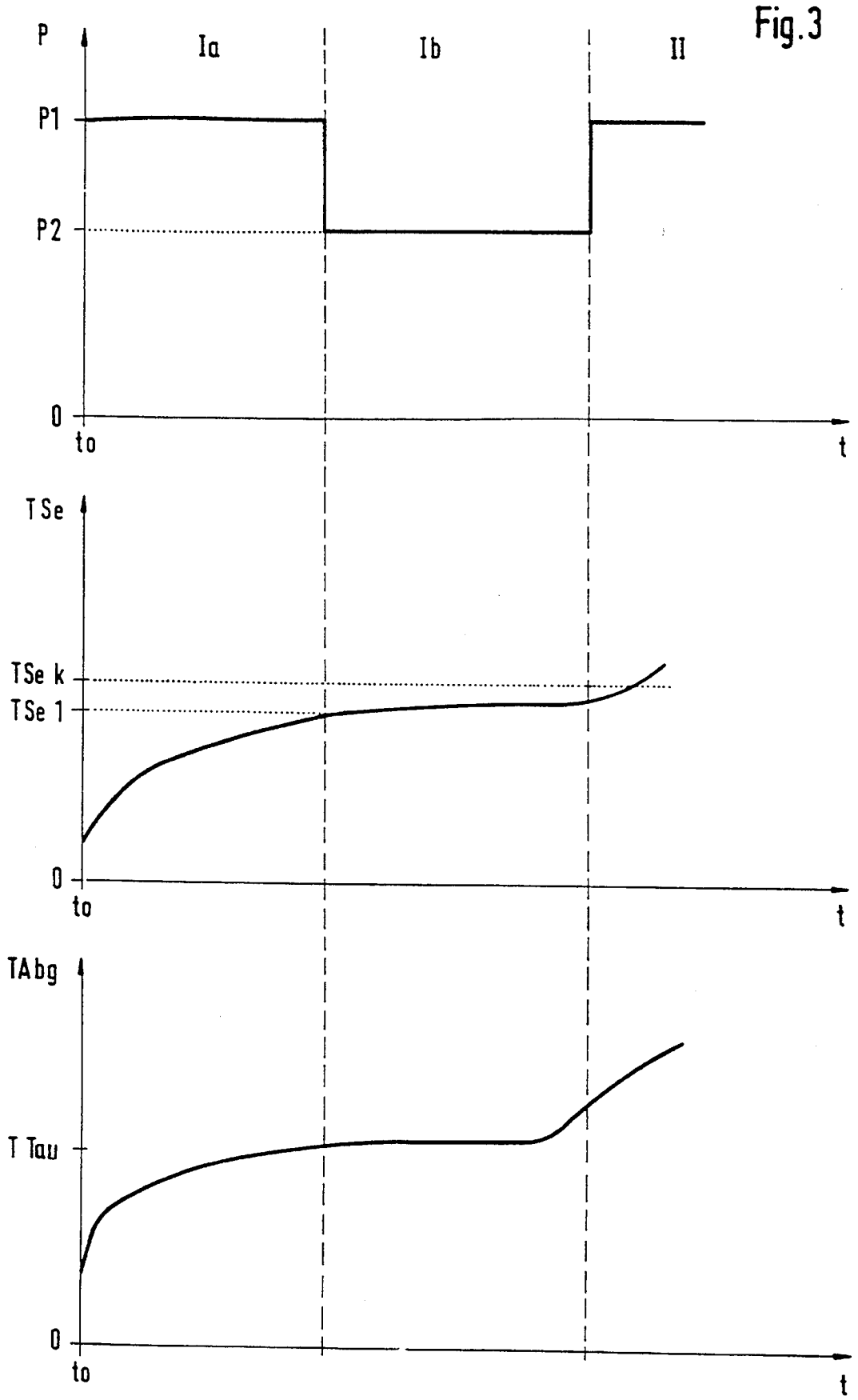
FIG. 3 shows charts of the behavior vs. time of the electrical power fed to the heating element (top), the temperature TSe of the oxygen sensor (center) and the temperature TAbg of the exhaust system in the vicinity of the oxygen sensor (bottom).

FIG. 3 contains charts which illustrate the behavior vs. time of the electrical power P (top) fed to the heating element 114, the temperature TSe of the oxygen sensor 112 (center) and the temperature TAbg in the vicinity of the oxygen sensor 112 (bottom). The time scale of the abscissa starts in each of the three charts when the internal combustion engine 100 is started or the heating element 114 is switched on at t=t0. Phase I, which was already defined in detail above, breaks down into two subphases: A subphase Ia and a subsequent subphase Ib. Phase II follows subphase Ib. The individual phases or rather subphases are separated from one other by vertical dashed lines.

All curves in FIG. 3 describe the case for which the coolant temperature of the internal combustion engine 100 lies below the threshold value TKM1 immediately before or immediately after the internal combustion engine 100 is started, i.e., a cold start is occurring. In relation to the flow chart shown in FIG. 2, this means that the condition queried in step 202 is met. As a result, the heating element 114 is initially operated with a nominal power P1 of, say, 18 W according to step 204 of the flow chart in FIG. 2. This can be read from the upper chart in FIG. 3 in which the electrical power P fed to the heating element 114 is plotted on the ordinate. During the subphase Ia, the electrical power P has a constant value of P1.

In the middle chart in FIG. 3, the temperature TSe of the oxygen sensor 112 is plotted on the ordinate. Within subphase Ia, it can be seen that the temperature TSe is rising starting at t=t0 as a result of the heating by the heating element 114. The temperature rise is also influenced by the exhaust gas flowing past the oxygen sensor 112.

In the lower chart in FIG. 3, the temperature TAbg of the exhaust gas or rather the exhaust channel 104 is plotted on the ordinate. The temperature TAbg initially climbs rapidly starting at time t=t0 and then tends near the end of subphase Ia towards a constant value of approx. 50° to 60° C., i.e., approx. the condensation point temperature TTau.

The end of subphase Ia is then reached when the temperature TSe of the oxygen sensor 112 exceeds the threshold value TSe1 of, say, 250° to 300° C. In the flow chart in FIG. 2, this is the case when the condition of query 206 is met for the first time. At this moment, subphase Ia ends and subphase Ib begins. The electrical power P which is applied to the heating element 114 is reduced to a lower value P2 of, say, 11 W (see FIG. 3, upper chart). The reduction in the electrical power P results in the temperature TSe of the oxygen sensor 112 taking on an approximately constant value (see FIG. 3, middle chart).

The moment of the transition from subphase Ib to phase II ensues from the behavior of the temperature TAbg vs. time. The temperature TAbg in the vicinity of the oxygen sensor 112 is approximately constant over a longer time period in subphases Ia and Ib after rising starting at time t=t0 and has a value of approx. 50° to 60° C., which corresponds more or less to the condensation point temperature TTau. TAbg remains at this value until the liquid in the exhaust channel 104 in the vicinity of the oxygen sensor 112 and upstream has completely changed over to the gaseous state. The rise in temperature TAbg near the end of subphase Ib thus indicates that no more liquid is present in the vicinity of the oxygen sensor 112. For this reason, the moment of transition from subphase Ib to phase II coincides with a rise in the temperature TAbg above the condensation point temperature TTau.

From the upper chart in FIG. 3, one can see that at the start of phase II the electrical power P which is applied to heating element 114 is increased from P2 to P1. This corresponds to step 212 of the flow chart in FIG. 2, which is executed if the condition queried in step 208 is not met. As can be seen from the middle chart in FIG. 3, the increase in electrical power P results in an increase in the temperature TSe of the oxygen sensor 112.

The system according to the invention operates more and more reliably as the points in time of the transition from subphase Ia to Ib and the transition from subphase Ib to phase II are determined with greater accuracy. Below, it is explained based on preferred exemplified embodiments how these points in time can be determined.

The characteristics of ceramic sensors are often temperature-dependent so that the temperature TSe of the sensors can be determined in these cases with no additional thermoelements based on the behavior of the sensors. This is also true of the oxygen sensor 112 described here; the electrical resistance of this device falls off sharply as the temperature increases.

Figure 4:
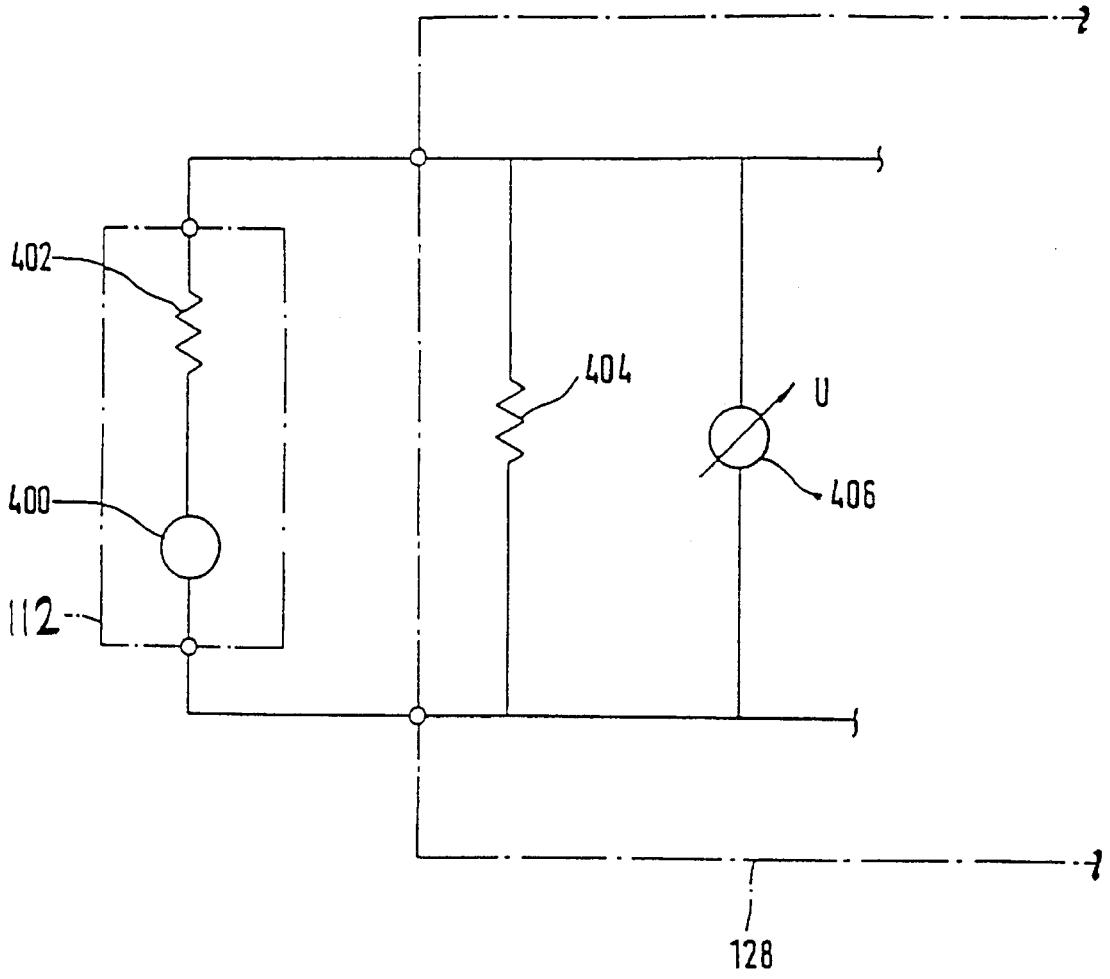
FIG. 4 shows a schematic diagram of an apparatus for measuring the temperature TSe of the exhaust sensor according to the present invention.

FIG. 4 illustrates a circuit known per se with which it is determined based on the electrical resistance of the oxygen sensor 112 whether the oxygen sensor 112 has exceeded a threshold value TSe1, i.e., the circuit serves to determine the moment of the transition from subphase Ia to subphase Ib.

As an equivalent circuit for the oxygen sensor 112 (shown in dashed lines), a series arrangement of a voltage source 400 and a resistor 402 can be used. In parallel to this series circuit, a resistor 404 of, for example 51 kOhm is connected. The voltage drop across resistor 404, which is a component of the control unit 128 (shown in dashed lines), is measured and evaluated, which is indicated by a voltage meter 406. The oxygen sensor 112 has a resistance 402 of about 10 MOhm in the cold state and about 50 Ohm in the hot state. The falling voltage across resistor 404 is a function of the resistance 402 of the oxygen sensor 112 and can thus be used to make conclusions with regard to the temperature TSe of the oxygen sensor 112.

Besides the change in resistance, another effect occurs when the temperature of the oxygen sensor 112 is increased. As a general rule, the oxygen sensor 112 already generates a voltage when it is at a temperature below the critical temperature TSeK, this voltage being a function of the oxygen content of the exhaust gas, for example, when the threshold value TSe1 is exceeded. As a result, there exists as a general rule a temperature range in which the oxygen sensor 112 is ready for operation without the existence of a appreciable risk of damage upon contact with liquid.

Accordingly, it is already possible in the beginning phase after a cold start (phase I) to bring the oxygen sensor 112 to its operating temperature and thus allow control of the air/fuel ratio without having to accept the risk of damage to the oxygen sensor 112 due to contact with liquid, i.e., in this case the oxygen sensor is operated in the temperature range between the threshold value TSe1 and the critical temperature TSeK. It is highly desirable to activate the oxygen sensor 112 as soon as possible after the engine is started in order to minimize the emissions. Nonetheless, a further increase in the temperature TSe of the oxygen sensor 112 is necessary in phase II since the oxygen sensor 112 has many functional advantages at higher temperatures.

The moment of the transition from subphase Ib to phase II can also be determined without the temperature sensor 116 using the following method, i.e., the temperature sensor 116 is not absolutely necessary in the system according to the invention and can be omitted. It may be determined using a model which simulates the temperature curve of the exhaust gases when the exhaust gases have exceeded the condensation point temperature TTau. The air mass or air volume measured by the air-mass flowmeter or air-flow-rate meter 106 is used as an input parameter to the model. In the model, the air mass or air volume is integrated and the integral is compared with an empirically determined threshold value. The threshold value is determined using the total air mass or air volume drawn in by the internal combustion engine 100 since the cold start. It is the point at which the temperature TAbg exceeds the condensation point temperature TTau based on experience. As soon as the comparison performed as part of the model indicates that the threshold value has been reached, it can be assumed that the temperature TAbg has exceeded the condensation point temperature TTau.

When empirically determining the threshold value for the integrated air mass or air volume during the application phase, it should be noted for which section of the exhaust channel 104 the model is intended to be used. The threshold value for the vicinity of the oxygen sensor 120 is significantly larger than the threshold value for the vicinity of the oxygen sensor 112. The difference is caused primarily by the fact that, in the case of oxygen sensor 120, large quantities of heat energy are drawn from the exhaust gases to heat the catalytic converter 118 and evaporation of the condensed water accumulated in the catalytic converter 118 is thus delayed. Not until the condensed water upstream from the oxygen sensor 120 is completely evaporated does the temperature TAbg of the exhaust gas in the vicinity of the oxygen sensor 120 climb past the condensation point temperature TTau.

As part of the system according to the invention, it is also possible to activate the heating element 114 even before the internal combustion engine 100 is started. In this context, the activation is triggered by an event occurring prior to the starting of the internal combustion engine 100, such as the opening of the vehicle door, switching-on of the interior lighting, activation of the seatbelt buckle, or seating in the driver's seat. The time between starting the internal combustion engine 100 and readiness of the oxygen sensor 112 for operation can thus be reduced, which can be important in conjunction with a heatable catalytic converter, for example. The depicted measures for protecting the oxygen sensor 112 can also be used in this variant.

The temperature TAbg represents the temperature in the vicinity of the oxygen sensor 112 and 120. Depending on the exemplified embodiment, this can be the temperature of the exhaust gases, the wall of the exhaust channel 104 or the catalytic converter 118. If it is possible to measure several of these temperatures, TAbg can also be determined by averaging at least two of the temperatures.

Instead of the coolant temperature, the temperature of the wall of the exhaust channel (104) or the temperature of the catalytic converter (118) can be used to determine if a cold start of the internal combustion engine (100) is occurring. The prerequisite for this, however, is the presence of an appropriate temperature sensor. If, when the internal combustion engine (100) is started, the temperature measured by the sensor is less than the condensation point temperature (TTau), then a cold start is occurring.

What is claimed is:

1. An apparatus for controlling a heating element, the heating element heating a first sensor disposed adjacent to or downstream of a catalytic converter in an exhaust passage of an internal combustion engine, the apparatus comprising:

a second sensor for measuring an operating parameter of the engine, and for generating a signal based thereon; and a control unit coupled to the second sensor for determining an operating state of the engine as a function of the signal, and for controlling the heating element such that the first sensor operates below a pre-selected temperature when the control unit determines that the operating state is indicative of the presence of liquid in a part of the exhaust passage proximate to the first sensor, and operates above the pre-selected temperature when there is no liquid in the part of the exhaust passage proximate to the first sensor.

2. The apparatus according to claim 1, wherein the second sensor is a temperature sensor.

3. The apparatus according to claim 1, wherein the signal is generated when the temperature of an engine coolant lies below a pre-selected value.

4. The apparatus according to claim 1, wherein the signal is generated when a temperature in the exhaust passage lies below a pre-selected value.

5. The apparatus according to claim 1, wherein the first sensor is a ceramic sensor.

6. The apparatus according to claim 1, wherein the first sensor is an oxygen sensor.

7. The apparatus according to claim 1, wherein the control unit includes a microprocessor.

8. An apparatus for controlling a heating element, the heating element heating a ceramic sensor disposed adjacent to or downstream of a catalytic converter in an exhaust passage of an internal combustion engine, the apparatus comprising:

a sensor for measuring an operating parameter of the engine, and for generating a signal based thereon; and a control unit coupled to the sensor for determining one of a first operating state of the engine indicative of the presence of liquid in a part of the exhaust passage proximate to the ceramic sensor, and a second operating state of the engine indicative of the absence of liquid in the part of the exhaust passage proximate to the ceramic sensor, as a function of the signal, and for controlling the heating element such that the ceramic sensor operates below a pre-selected temperature when the first operating state is determined, and operates above the pre-selected temperature when the second operating state is determined.

9. The apparatus according to claim 8, wherein the heating element is operated with reduced power during the first operating state.

10. The apparatus according to claim 8, wherein during the first operating state the heating element is operated for a pre-selected time interval at high power and thereafter at low power.

11. The apparatus according to claim 8, wherein a temperature in the exhaust passage is derived from a temperature-dependent characteristic of the ceramic sensor.

12. The apparatus according to claim 8, further comprising a temperature sensor coupled to the control unit and disposed in close proximity to the ceramic sensor, for measuring a temperature in the exhaust passage.

13. The apparatus according to claim 8, wherein the sensor is one of an air volume sensor and an air mass sensor.

14. The apparatus according to claim 8, wherein an integration is performed on the signal from the sensor.

15. The apparatus according to claim 14, wherein the integrated signal is compared to a pre-selected value.

16. The apparatus according to claim 8, wherein during the first operating state, the ceramic sensor is operated in a temperature range between a threshold temperature, above which the ceramic sensor is at least conditionally ready for operation, and the pre-selected temperature.

17. The apparatus according to claim 8, wherein the control unit energizes the heating element prior to the first operating state in response to an external signal.

18. A method of controlling a heating element, the heating element heating a sensor disposed adjacent to or downstream of a catalytic converter in an exhaust passage of an internal combustion engine, comprising the steps of:

measuring an operating parameter of the engine and generating a signal based thereon;

determining an operating state of the engine as a function of the signal;

controlling the heating element such that the sensor operates below a pre-selected temperature when the operating state is indicative of the presence of liquid in a part of the exhaust passage proximate to the sensor, and operates above the pre-selected temperature when there is no liquid in the part of the exhaust passage proximate to the sensor.

19. The method according to claim 18, wherein the operating parameter is an engine temperature.

20. The method according to claim 18, wherein the operating parameter is an exhaust passage temperature.

21. The method according to claim 18, wherein the heating element is operated with reduced power when the operating state is indicative of the presence of liquid in the part of the exhaust passage proximate to the sensor.

* * * * *